United States Patent [19]

Hawkins

[11] 4,441,415

[45] Apr. 10, 1984

[54] CRUSHER FOR SCRAP METAL AND THE LIKE

[76] Inventor: Peter A. T. Hawkins, White Cross Farm, Cholsey, Oxfordshire, England

[21] Appl. No.: 326,420

[22] Filed: Dec. 1, 1981

[30] Foreign Application Priority Data

Dec. 5, 1980 [GB] United Kingdom ..... 8039004
Jun. 26, 1981 [GB] United Kingdom ..... 8119865

[51] Int. Cl.[3] ..... B30B 9/32

[52] U.S. Cl. ..... 100/35; 100/91; 100/100; 100/215; 100/218; 100/233; 100/901

[58] Field of Search ..... 100/901, 215, 218, 233, 100/91, 35, 269 R, 295, 100

[56] References Cited

U.S. PATENT DOCUMENTS

| | | | |
|---|---|---|---|
| 2,875,912 | 3/1959 | Thresher | 100/100 X |
| 2,932,244 | 4/1960 | Moyer | 100/901 X |
| 3,242,851 | 3/1966 | Brawley | 100/100 X |
| 3,266,413 | 4/1966 | Sharp et al. | 100/233 |
| 3,273,493 | 9/1966 | Smiltneer | 100/233 X |
| 3,413,914 | 12/1968 | Ballard | 100/100 |
| 3,486,440 | 6/1969 | Schaffler | 100/233 |
| 3,615,084 | 10/1971 | Wasinger | 100/901 X |
| 3,651,754 | 3/1972 | Forest | 100/91 |

FOREIGN PATENT DOCUMENTS

| | | | |
|---|---|---|---|
| 223602 | 8/1959 | Australia | 100/100 |
| 373065 | 7/1975 | Sweden | 100/233 |

*Primary Examiner*—Billy J. Wilhite
*Attorney, Agent, or Firm*—Bacon & Thomas

[57] ABSTRACT

Apparatus for crushing scrap metal, especially for flattening car body shells, has a jaw mechanism (11) which includes a lower jaw member (30) and an upper jaw member (50). The lower jaw carries a platform (31) for the object to be crushed and the upper jaw carries a flat press plate (55). The two jaw members are hinged together behind both the platform and the press plate, and above both the platform and the press plate when the jaws are closed to a position in which the press plate is parallel to, yet spaced from, the platform. Side plates (32) and a rear gate (80) may be provided to contain light scrap in the jaws. The jaws may be tiltable and/or vehicle mounted, and may be provided with front fork tines (71) to act as an entry ramp and for manipulating the scrap.

23 Claims, 8 Drawing Figures

CRUSHER FOR SCRAP METAL AND THE LIKE

This invention relates to a crusher for scrap metal and the like, particularly one that is suitable for crushing motor vehicle bodies, especially car body shells.

The metal content of scrap car body shells can be reclaimed if the bod shell is transported to a plant for that purpose. Commonly, various components of the car are first removed; these include the engine, gearbox, transmission and road wheels as well as the seats and electrical wiring. The stripped shell is almost as bulky as the original car, but weighs much less, typically 300 kg. The volume capacity of a truck for transporting the shells to a reclamation plant may be, for example, only six shells, which is likely to represent a highly inefficient under-utilisation of the truck's weight-carrying capacity.

If the body shells are first compressed to a height of 15 to 30 cm., the truck may be able to carry about five times as many shells in a single journey to the reclamation plant. In addition, crushing can be useful in order to save space in a scrapyard. Suitable car body shell crushing machinery has until now been very expensive, has tended to be immovable or inconvenient to move and has required separate means, including the use of a vehicle to carry the shells, to feed the crusher.

Among the many previously proposed crushing machines is that described in U.S. Pat. No. 3,266,413. This machine is transportable, in that it can be winched on to a truck bed for transportation, but it is effectively static once it has been delivered to a site and set up for use. A principal feature of this machine is that is uses a stepped press arm, pivoted above a long platform, which when fully closed resembles a flight of stairs inverted through 180°. As a car body shell is advanced through the flattener, it is progressively crushed by the successive steps on the press arm, each step reducing the height of a section of the body shell to fit under the next step. The press arm is fully raised after each flattening stroke in order to allow the car body shell to advance one section. Any incompressible parts left in the shell, such as engine, gearbox or axles, or any especially springy sections, cannot be accepted under the final steps of the press arm unless the press arm is removed and refitted farther from the platform, and will not pass out of the exit from the flattener. Since several sections of the car must be crushed at one time, it is necessary to provide powerful hydraulic rams and a correspondingly massive and expensive construction for the machine.

U.S. Pat. No. 3,486,440 describes a machine permanently mounted on a truck bed. Folding platforms are provided on either side of the truck for use during car body flattening, which severely limit its manoeuverability in, for example, a car scrapyard. The car bodies pass across the truck bed through a press trough past two hinged press plates mounted on bell-crank levers.

According to one aspect of the present invention there is provided apparatus for crushing objects of scrap metal and the like, having a jaw mechanism comprising a lower jaw member having a platform on which an object to be crushed can be carried, an upper jaw member including a press plate linked to the platform through a pivotal connection, and closure means for urging at least one of the press plate and the platform towards the other whereby to crush a said object on the platform, wherein: the press plate has a single generally planar operative surface; the jaw mechanism can be closed at least as far as a position in which the press plate and the platform are parallel yet spaced apart; the axis of the said pivotal connection is offset such that, in the said parallel position of the press plate and platform, and when the platform is at the same time horizontal, the said axis is above the plane of the press plate and, seen in plan view, does not cross the perimeter of the press plate or of the platform, the side of the platform beyond which the axis is offset thereby defining the rear of the platform and of the jaw mechanism; and the jaw mechanism being open or openable at the so-defined rear to discharge the crushed object from the rear of the platform.

According to a further aspect of the invention there is provided a method of crushing scrap metal and the like, comprising:

(a) providing a jaw mechanism comprising a lower jaw member having a platform pivotally connected to an upper jaw member including a press plate which has a single generally planar operative surface, the axis of the said pivotal connection being offset such that, when the platform is horizontal, the axis is above and entirely beyond one side of the platform, that side thereby being defined as the rear of the platform;

(b) loading a leading end of an object to be crushed on to the platform from a side opposite the above-defined rear thereof;

(c) urging the press plate towards the platform to crush the object until either the said single operative surface of the press plate has advanced to a position where it is parallel to the platform, is closer to the plane of the platform than is the said axis, and, seen in plan view, does not extend across the said axis, or the rigidity of the object prevents the further advance of the press plate towards that position;

(d) moving the press plate away from the platform;

(e) loading a next portion of the object on to the platform while withdrawing the crushed end from the rear of the platform; and (f) repeating steps (c), (d) and (e) in sequence until the entire object has been crushed and withdrawn from the rear of the platform.

The term "substantially planar" as used herein with reference to the operative surface of the press plate is intended to denote that the overall configuration of the surface is planar, although the surface may be profiled or texured for the purpose of providing non-slip or similar properties, as found for example on steel flooring plates.

Effective car-crushing apparatus according to the invention can be made relatively lightweight, portable and inexpensive.

When the jaw is closed to the point where the press plate lies parallel to the platform, a car body or other object in the crusher will be reduced to having substantially parallel top and bottom faces and an overall height which is determined by the geometry of the jaw but which is preferably 15 to 30 cm. In this form it is conveniently stackable and transportable, and is suitable for modern cryogenic reclamation techniques.

By providing the pivot axis to the rear of the press plate, it is ensured that the whole of the press plate, including the rear end, rises from the platform upon opening the press plate from the parallel position. By setting the axis to the rear of the rear edge of the platform, additional clearance space is provided behind the platform to facilitate the removal of long or bulky crushed objects.

In this apparatus the press plate and the platform are inclined at an angle to each other when the jaw mechanism is opened beyond the parallel configuration. This allows a car body shell to be taken into the jaws on the platform until it is hard against the sloping and flat operative surface of the press plate, possibly with some preliminary crushing of the leading end depending on the force with which it is loaded into the crusher jaws, thereby correctly positioning the uncrushed portion over the platform.

Preferably, the jaw mechanism can be opened at least as far as a position in which part of the operative surface of the press plate is as far from the plane of the platform as the pivot axis is from the plane of the platform; and more preferably, it can be opened until substantially all the upper jaw member is farther from the plane of the platform than the pivot axis is from the plane of the platform. With the pivot axis being located behind the press plate and platform, it is possible to accept objects for crushing of a considerable ramge of sizes, without the need to flatten them progressively in different stages of the apparatus, and with the ability to crush each portion of the object that is admitted into the jaw mechanism to the desired thickness in a single stroke. The upper jaw member need only be raised as far as is necessary to admit the next portion of the object, thereby allowing the total time required for flattening an object to be reduced in proportion with the height of the object. The pressure exerted by the press plate on particularly resistant parts of the object can be increased by limiting the advance of the object into the jaws, so that a reduced area of the press plate is used to transmit the full force of the closure means, and if flattening is still not possible there will normally be sufficient clearance behind the press plate and platform to let that part of the object continue through the jaw mechanism uncrushed without causing a blockage.

The apparatus may be provided with side pieces to guide and contain the scrap on either side of the jaw mechanism. Such side pieces are preferably not parallel, so that the crushed scrap can be released towards the wider end, which is most preferably the rear.

The apparatus may be provided with an openable gate at the rear of the platform, to prevent the discharge of scrap from the platform until the gate is opened, especially when the aforementioned side pieces are also present, in which case the crusher is effectively an open fronted box when the gate is closed. It can then be loaded with smaller scrap objects, such light scrap including household appliances such as cookers, refrigerators and washing machines and other scrap metal such as oil drums and cans, as well as loose car doors, bonnets (hoods), hub caps and other trim from the scrapyard. The gate preferably comprises spaced bars, and can be opened clear of the platform. Especially when formed as a box in this way, the jaw mechanism is preferably tiltable so that the box opening is on the highest side, for loading, and the gate is underneath, for discharging.

The invention is illustrated by way of example in the accompanying drawings, in which.

Figure 1:
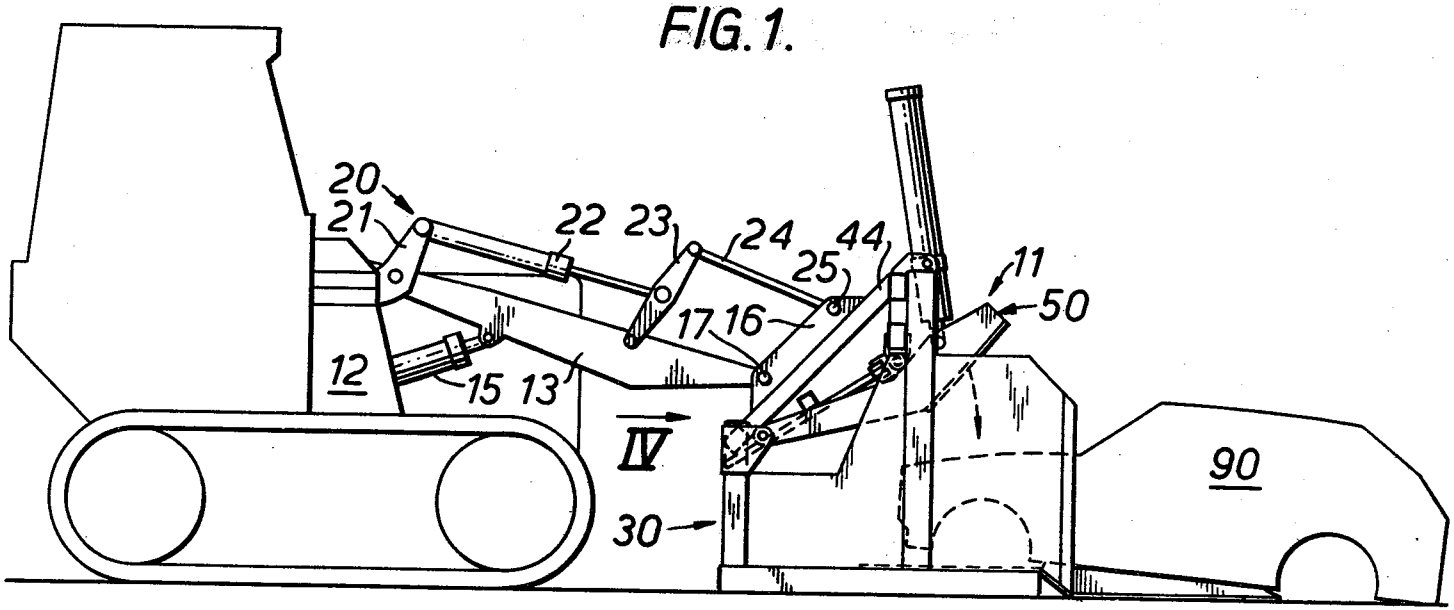
FIG. 1 is a side elevation of the jaw mechanism mounted on a loading shovel in place of the usual bucket, with a car body shell partially on the platform, before crushing.

In FIG. 1 the crusher jaw mechanism 11 is mounted on a conventional track-laying tractor body 12 as used in a heavy duty front loading machine, provided with a diesel engine, a drive transmission, a hydraulic power supply and controls, and an operator's cab. A pair of parallel laterally spaced main lifting arms 13 extend forwardly on either side of the tractor body and engage mounting plates 16 on the crusher jaws by means of pivot pins 17. The arms 13 pivot on the tractor body so that they can be raised and lowered thereon by hydraulic piston and cylinder assemblies 15 associated with each arm, in order to raise or lower the jaw mechanism.

Associated with each main lifting arm 13 is a secondary linkage 20 controlling the tilt of the crusher jaws. The linkage 20 includes a link 21, pivoted at one end to the tractor body, at its mid-point to the main arm and at its other end to a hydraulic piston and cylinder assembly 22. This couples the link 21 to the mid-point of a further link 23, which has one end connected to the main arm to complete an approximately parallel linkage depending on the precise extension of the piston and cylinder 22. The other end of the link 23, remote from the main arm, is coupled through a bar 24 to the mounting plates 16 by means of a pivot pin 25, to complete a second substantially parallel linkage.

The piston and cylinder 22 can be extended to tilt the crusher jaw mechanism towards its fully forward position, in which it would be tilted somewhat forward of the horizontal orientation shown in FIG. 1. Contraction of the assembly 22 would rotate the jaw mechanism towards its fully back position, in which it would be tilted back to an orientation that is near vertical or leaning back beyond vertical.

The generally parallel nature of the secondary linkage 20 is such that raising or lowering the main lifting arms 13 does not substantially alter the tilt of the crusher jaw mechanism. Variations on this kind of linkage are well known in the front loading machine art for the purpose of raising or lowering a bucket, shovel or fork without tilting it, and are acceptable alternatives to the linkage shown.

The jaw mechanism as illustrated in FIGS. 1 to 7 comprise a rigid frame structure 30 including a crushing platform 31 and side plates 32, a pivoted upper jaw member 50 mounted in the frame between the side plates and over the platform, hydraulic drive means for the upper jaw member and an auxiliary rear gate 80 having an associated opening and closing mechanism.

The frame structure 30 is a welded steel fabrication of plates and rectangular hollow sections. The platform 31, which forms part of a fixed lower jaw member, is carried on a framework comprising a front cross member (not shown) and a rear cross member 34, joined by side members 35 extending rearwardly beyond the platform and rear cross member. Further similar members provide reinforcement under the platform.

A pair of front columns 36 stand one on either side of the platform and are joined at their top ends by an overhead main cross beam 37, and below the main beam by a secondary cross beam 38. A pair of shorter rear columns 40 stand one on each rear end of the side members 35 and are joined at their upper ends by a rear overhead cross beam 41. A pair of laterally spaced inclined mounting beams 44 extend from the rear overhead cross beam forwardly and upwardly to the main overhead cross beam, and carry the mounting plates 16.

The space between the rear overhead cross beam 41 and the rear edge of the platform 31 is essentially unobstructed and defines a clear rear exit from the jaw mechanism, bounded at either side by the rear columns 40 and the rear ends of the side members 35.

The side members 35 also carry vertical side plates 32, which are reinforced by the columns 36 and 40. These side plates enclose the sides of the jaw mechanism. Each side plate has an outwardly flared front vertical edge 33 to assist in guiding a car body shell or the like into the jaws. In order to avoid a crushed body shell jamming in the jaws as a result of lateral spreading, the side plates are not parallel, but are set at a shallow angle such that the distance between them steadily increases from the front to the back of the jaw mechanism 11. Suitable angles are 1° or more on each side, between 1° and 2° or 3° being commonly adequate, which corresponds to an outward displacement of the rear end of each side plate of about 1 cm. or more in every meter length.

A guide ramp 70 is provided at the front edge of the platform 31. Mounted on the ramp ahead of the platform are a pair of laterally spaced forwardly extending fork tines 71 of inverted T section. The side flanges 72 of the tines taper in at their tips towards the upright web 73, each of which is tapered throughout its full length, rising from a point at the front tip, initially steeply and thereafter gradually to a highest point above the rear edge of the ramp and the front edge of the platform, and finally dropping sharply back to terminate at platform level.

The upper jaw 50 comprises two pairs of parallel cranked arms 51 connected at the head of the jaw by a rectangular framework of beams 52 which provides support and reinforcement for a press plate 55 carried on the lower face of the framework. The rearmost crossbeam of the framework carries on its rear face, between the two pairs of cranked arms, a series of triangular auxiliary plates 56 angled upwards at about 45° and reinforced by gusset plates 57.

The upper jaw is mounted in the rigid lower jaw frame structure 30 by means of pivot pins 47 which hold the rear ends of the cranked arms 51 in brackets 48 carried on the tops of the rear columns 40 and on the ends of the rear overhead cross beam 41.

Movement of the upper jaw in the frame structure 30 is controlled by a hydraulic cylinder 60 pivotally mounted between pairs of plates 61 at each end of the two forward cross beams 37 and 38. Piston rods 62 are connected to the head of the upper jaw above the press plate 55 by means of pins 63 located between each pair of cranked arms 51. The cylinders are mounted so that it is the expansion stroke of the piston that drives the press plate towards the platform 31, and the less powerful contraction stroke that raises the press plate thereafter. The cylinders are so positioned in the jaw mechanism that, on expansion to extend the piston rods, the approximate midpoint of the press plate in the upper jaw is thrust directly towards the approximate midpoint of the platform in the lower jaw, thereby maximising the efficiency of the jaw as a crushing mechanism.

The arms 51 in the upper jaw for carrying the press plate are cranked at an angle of 30–35°. In the embodiments of the invention illustrated, which are intended for flattening scrap car body shells in particular, the pins 47 about which the upper jaw rotates are set at a height of about 80 cm. above the level of the platform, and are about 1 m. from the rear edge of the press plate. As a result, the press plate is parallel with the platform when the upper jaw is closed to about 15 cm. from the platform (FIG. 2), which is considered a desirable thickness for the flattened body shell. However, the jaws can still crush and discharge a car body that has not been stripped of relatively incompressible components, such as engine, gearbox and axles, or even a complete car, because of the vertical clearance of 65–80 cm. below the rear cross beam 41 to platform level and the even greater total clearance of up to 1 m. between the rear cross beam and the rear edge of the platform. When the upper jaw is fully raised, there is a clearance of at least 90 cm. between the rear edge of the platform and the nearest parts of the upper jaw, which are points on the arms 51.

Since the axis about which the upper jaw rotates, namely the axis of the pins 47, is parallel to both the plane of the press plate and the plane of the platform, and lies above both when the press plate and platform are parallel (considering their horizontal orientation) the movement of the press plate towards the platform has a rearward component during the final stage, when the press plate is below the said axis. This has the benefit of tending to draw the body shell or other object being crushed into the jaw mechanism, to counter any tendency to squeeze the object back out of the jaws. When the upper jaw is raised to its maximum extent (FIGS. 1, 3 and 8), in which position the arms 51 are in abutment with the secondary cross beam 38, the press plate is angled upwards at about 45–50° to the horizontal and the triangular auxiliary plates 56 are near parallel to the platform, and substantially the whole of the upper jaw member 50 is above its axis of rotation, the press plate can act as a solid deflector which is capable of effecting a preliminary crushing of any high body shell, such as that of a large car or van, which is rammed into the jaws. As illustrated, the leading edge of the press plate in this position is about 140–150 cm. above the platform, and the rear edge is about 90 cm. above the platform.

The jaw mechanism 11 is shown (FIGS. 1 to 7) fitted with an optional rear gate 80 between the front columns 36 behind the press plate. The gate is pivoted on hinge pins 85 in plates 84 mounted on the secondary cross beam 38, and can quickly be disconnected when not required by removing the hinge pins. The gate comprises an array of steel bars 81 extending downwardly from a horizontal beam 82 and reinforced by a second, lower, horizontal beam 83. The gate is actuated by a hydraulic cylinder 86 mounted in plates 87 carried on the two front cross beams 37 and 38, which has a piston rod 88 connected to a pair of plates 89 carried on the two gate beams 82 and 83. The gate is movable between a closed position (FIGS. 4, 6, and 7) in which the bars are substantially vertical when the platform is horizontal, and an open position (FIGS. 1 to 3), in which the bars are angled backwards as far as the rear cross beam 41 and leave the rear exit from the jaw mechanism substantially unobstructed.

The auxiliary plates 56 at the rear of the press plate 55 extend between each adjacent pair of bars 81 in the gate 80. These auxiliary plates prevent the upper jaw becoming jammed by small pieces of scrap which might otherwise get between the rear of the press plate and the gate when the gate if farthest away from the plate, i.e. when it is at the same height above the platform as the pivot pins 47, and preventing the plate from moving rearwards as it is closed further towards the platform.

The jaw mechanism 11 is suitably made of steel, and may be of welded construction. The platform 31 and the press plate 55 are suitably of tough, abrasion-resistant steel plate; the tines 71 and the bars 81 may be of high yield, high tensile steel.

Figure 2:
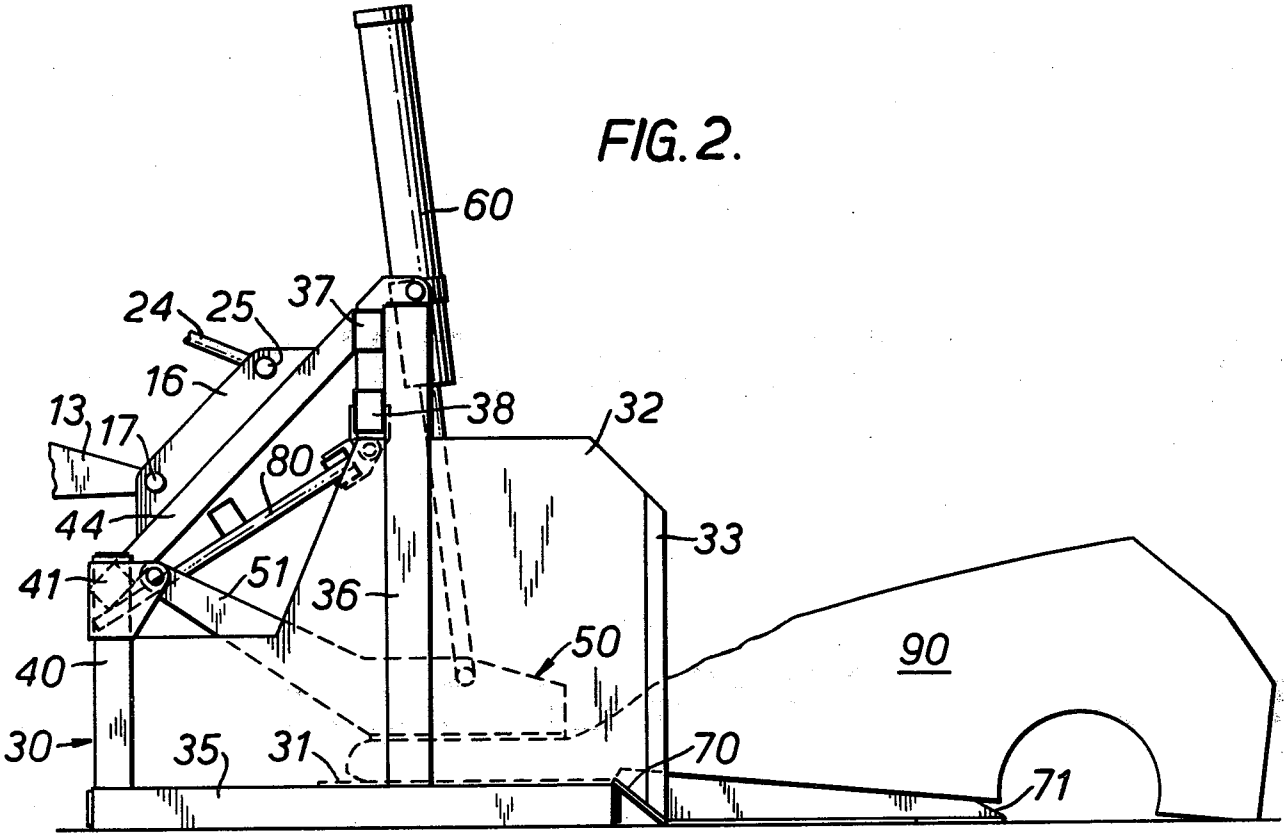
FIG. 2 is a side elevation, to a larger scale, of the jaw mechanism after a first closure of the jaw to crush the leading end of the car body shell.
Figure 3:
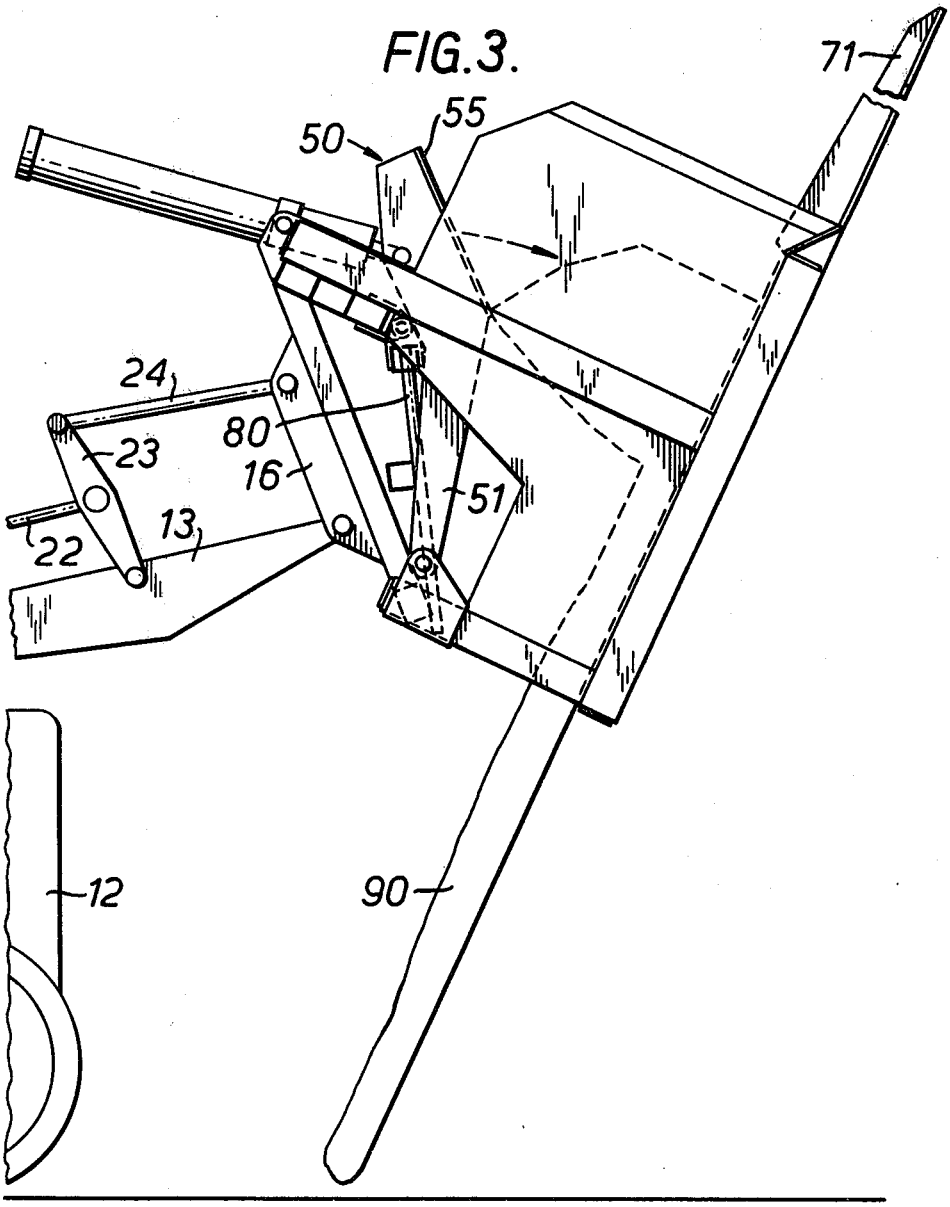
FIG. 3 is a side elevation of the jaw mechanism before the final closure of the jaws to crush the rear end of the body shell.
Figure 4:
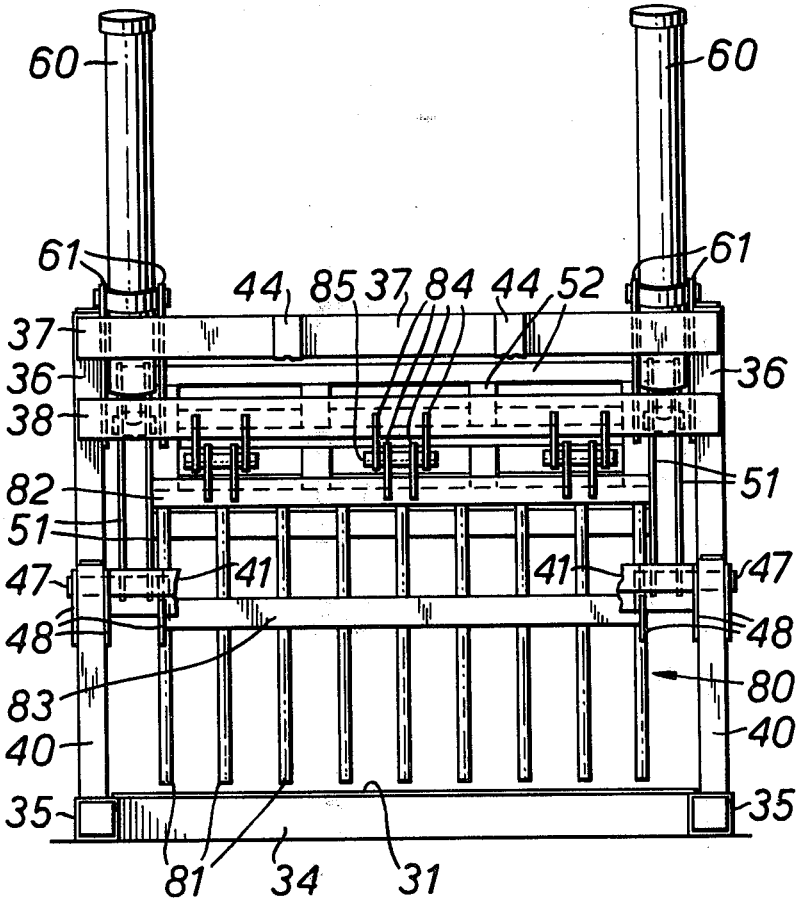
FIG. 4 is a rear elevation of the jaw mechanism, partly broken away, taken in the direction of the arrow IV shown in FIG. 1.

The use of the crusher jaw mechanism to flatten car body shells is shown in FIGS. 1 to 3. The tractor is first driven forwards with the jaw mechanism 11 lowered and the platform 31 level or inclined slightly down at the front so that the tines 71 are run under the car body 90 to raise it to platform height. The tines act as two very narrow ramps which probe under the car body which, if the wheels have been removed, will typically be resting on rough ground or concrete. Because they are much narrower than a single broad ramp, they are very much less likely to snag on the usual projections under the body shell, and if they do snag, they can be withdrawn by reversing the tractor and then run under the shell again in a slightly different location. The vertical webs 73 of the tines rise to a higher level than the platform so that as they are run under the body shell it is lifted high enough to allow any downwardly projecting or hanging parts of the shell to clear the leading edge of the platform, with assistance from the guide ramp 70 if necessary.

With the jaws open, and an obstacle if necessary behind the car body 90 to prevent its moving backwards, the body shell is forced on to the platform until it abuts the open press plate 55. FIG. 1 shows the upper jaw 50 fully open at this stage; normally, the upper jaw is only opened to raise the press plate sufficiently to admit the body shell to the jaws; the extent to which the upper jaw is opened accordingly depends on the size of the body shell. The initial impact of the angled press plate on the front of the shell may cause some preliminary crushing, and establishes that the shell is correctly located on the platform.

The tractor is then halted and the press plate closed (FIG. 2), flattening the front end of the body shell 90 in one single action, then reopened; the tractor is again run forward until an uncrushed part of the body shell abuts the press plate; after crushing again in a single movement, opening the jaw and running the tractor forward again, the body shell will probably be far enough over the tines 71 and on to the platform 31 to remain in the jaw mechanism when it is then raised and tilted back to allow gravity to slide the body shell further back into the jaws (FIG. 3). The last sections of the body shell can be crushed with its leading end resting on the ground, or raised in the air; the jaws can then be finally opened and the crusher mechanism raised further and tilted to vertical to allow the flattened shell to drop to the ground. It can then be stacked flat, or on end, using the tines and the front of the platform to manipulate and lift it; it can even be gripped in the jaws to move it.

It is also possible to use the whole crusher jaw mechanism 11 carried at the end of the lifting arms 13 to give scrap body shells a preliminary flattening by means of the dead weight of the jaws, pressing down on the body shells, especially the roofs, with the underside of frame 30 below the platform 31. The tines 71 can be used to stack two or three such treated shells together, and they can all be flattened together in the jaws in the same manner as previously described.

The throughput rate of the jaw mechanism is governed largely by the hydraulic pump capacity. An oil flow of 180 l./min. can enable 15 to 20 car body shells per hour to be flattened. This rate can be doubled at double the oil flow. By first staving in the car roofs and then flattening the shells in pairs, a skilled operator can achieve very high throughput rates.

Figure 5:
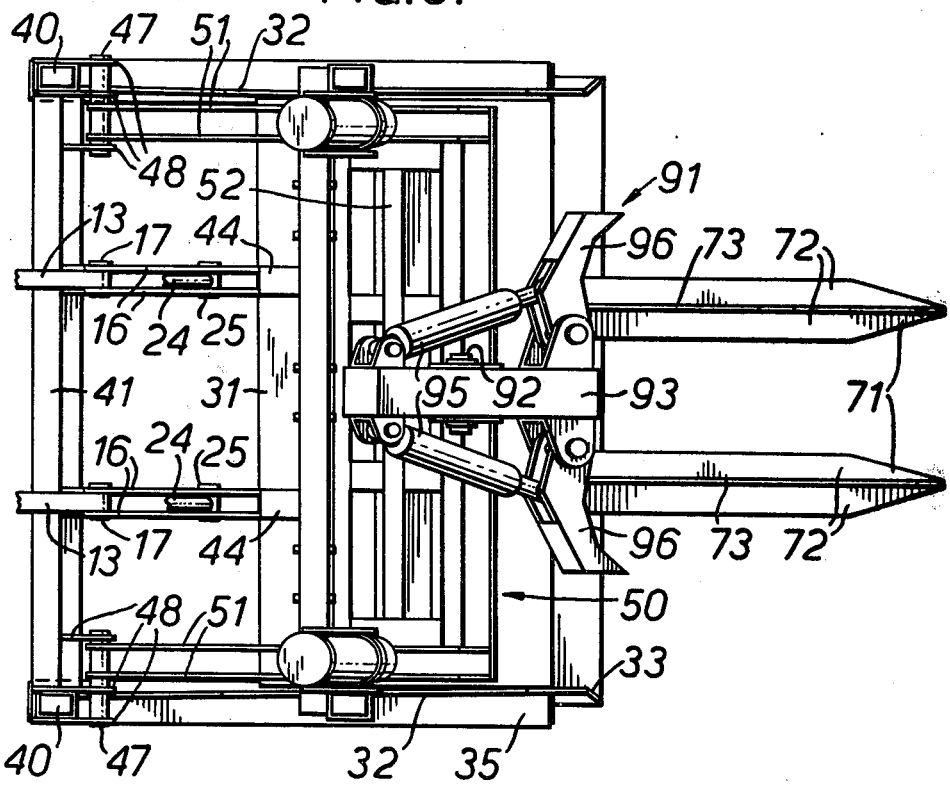
FIG. 5 is a plan view of the same jaw mechanism modified by the addition of an engine and transmission puller.
Figure 7:
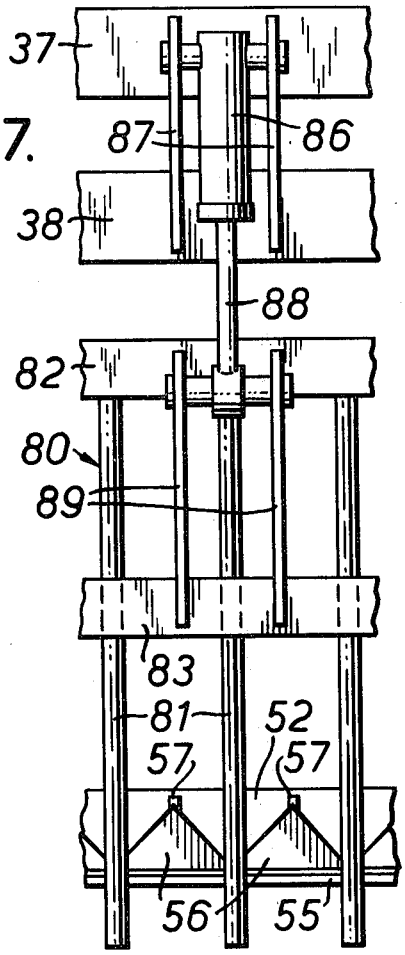
FIG. 7 is a fragmentary rear elevation of the jaw mechanism also illustrating the further components shown in FIG. 6.
Figure 6:
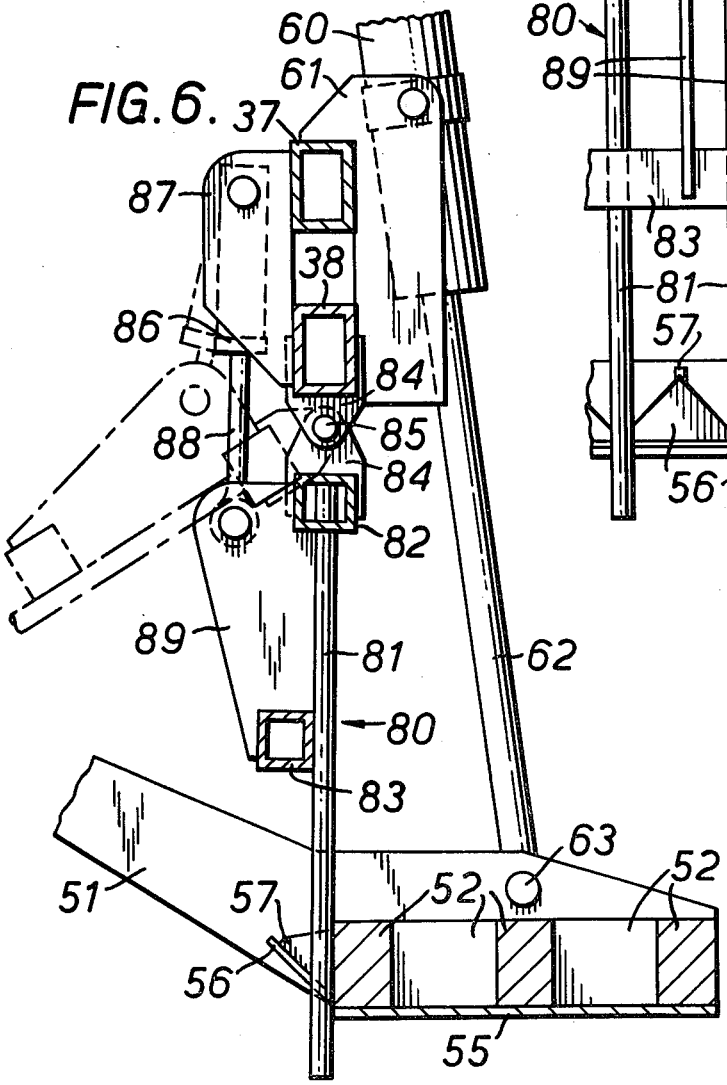
FIG. 6 is a fragmentary view to a further enlarged scale of part of the jaw mechanism in the position shown in FIG. 2, but in longitudinal section and showing further components relating to a rear gate.

FIG. 5 shows an engine grab 91 pivotally mounted in a bracket 92 on the front edge of the upper jaw member 50. A hydraulic ram (not visible in the drawing) located behind the bracket 92 acts to tilt a body member 93, which carries pincer grab jaws 96 powered by two hydraulic rams 95, between a forward lowered operative position and a rearward retracted position.

A car engine can be removed by opening the car bonnet (hood) with one of the tines 71, positioning the tines above the car wings on either side of the engine compartment, tilting the engine grab forward into its operative position, lowering the upper jaw member 50 to insert the grab into the engine compartment, closing the grab jaws 96 to grip the engine, and opening the jaw mechanism to pull the engine and any attatched car transmission components from the car body while holding the body shell down with the tines.

The above sequences for crushing car body shells take place with the rear gate 80 held open, or removed entirely: it is not required for this purpose. When the gate is shut, light scrap can be crushed. The crusher jaw mechanism will then normally be held in the tilted back position and filled by hand, with a magnet or by means of a grapple before crushing. It can then be unloaded by opening the gate, at a convenient location; or else more scrap can be added and compressed together with the previously compacted scrap before unloading, to build up a larger bale.

The hydraulic piston and cylinder assemblies used in the machine are all double acting, and can accordingly be driven and controlled on both their expansion and contraction srokes. Hydraulic power is taken from an oil pump in the tractor, and controlled from the cab, in the same way as in a conventional front loading machine.

The flattened scrap produced by the jaw mechanism is in a condition that is suitable both for economical transportation and for fragmentisation, for example after cooling in liquid nitrogen, as a preliminary to reclamation of the different valuable materials contained in it.

Figure 8:
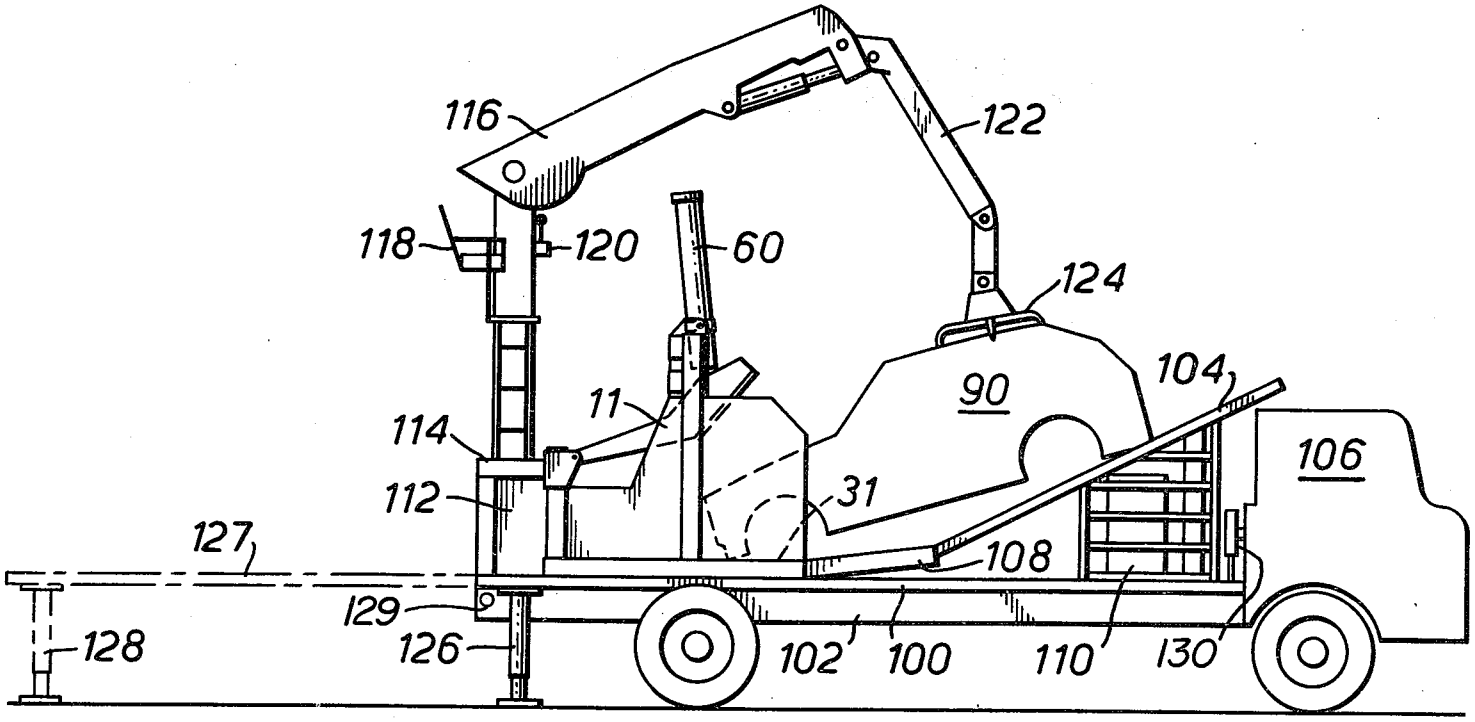
FIG. 8 is a side elevtion of the jaw mechanism carried on a truck and provided with a loading grab.

FIG. 8 illustrates an alternative method of using the crusher jaw mechanism 11. In this case the mechanism is carried on a bed 100 mounted over the chassis 102 of a truck. The jaw mechanism is positioned over the back axle of the truck, facing forwards. A steel ramp 104 is provided ahead of the jaws, sloping downwardly from above the driver's cab 106 to an entry ramp 108 of shallower incline leading on to the platform 31 in the jaws.

The jaw mechanism is in most respects as previously described, except that it lacks the inclined mounting beams 44, the rear gate 80, the front tines 71 and the entry ramp 70. It is however provided with a rear extension 112 to both its sides, which forms a base for a gantry 114 which carries a loading grab 116, and a seat 118 and hydraulic controls 120 for the crusher mechanism operator over the rear exit from the jaws.

The loading grab 116 has a 360° turning capability, has a hydraulic articulated boom 122 and carries a swivelling grapple 124 for picking up and moving each car body shell 90.

Steadying jacks 126 are provided under the rear of the bed 100. Sliding bars can be run out from under the rear of the bed to form a table 127, supported by jacks 128.

A hydraulic oil pump 110 is located under the ramp 104 for providing the necessary power and oil flow for the various hydraulic mechanisms. Alternatively, a pump can be run from a power take-off point on the truck engine.

In use, the flattening action of the jaw mechanism is as previously described. It is, however, more mobile than when carried on a front loading machine, in that it can more readily be driven on the public roads from one scrapyard to another. The grab 116 can perform all the necessary functions of picking up a body shell 90, placing it on the ramp 104 as shown in FIG. 8, pushing it into the jaws and pulling it out of the jaws on to the table 127, and finally unloading the flattened shell on to a stack or on to a transporter.

A number of modifications are possible to the arrangement described. For example, the entry ramps 104 and 108 are not essential, especially if the pump 110 is located elsewhere. More substantially, the bed 100 can be a demountable bed of a kind that is known per se; in such a case, the bed can be offloaded from the truck chassis 102 complete with all the flattening equipment, including the jaw mechanism 11, the loading grab 116 and the hydraulic pump 110, which can then be worked in a static location while the truck continues to be used to transport fresh body shells to the offloaded flattener and to remove the flattened shells when a full load has been assembled. The grab 116 is then used to load and unload the truck as well as to feed the jaw mechanism.

The loading grab is itself not essential in a demountable crusher jaw, because when the jaw has been offloaded it is then relatively simple to use other means for feeding the flattener, such as a winch or the like for pulling car body shells through the jaws or a ram or suitable vehicle for pushing them through. The jaw mechanism 11 can be used in this way without any need to provide for its transport on the truck.

Another alternative arrangement on the truck, without any need for the ramps 104 and 108, and either without the loading grab or with it relocated to the side of the bed 100, is to provide a tipping mechanism for the bed of a kind that is known per se, such as a pivot point 129 and a suitable hydraulic lift cylinder 130 as shown in FIG. 8; in this case, once a body shell has been loaded on to the bed in front of the open jaws, the front of the bed is raised and the shell is flattened in the usual way, relying on gravity to draw it through the jaw mechanism between flattening steps. In this arrangement the rear gate 80 may also be used for crushing light scrap.

It is not essential for the jaw mechanism to be operator controlled at all times. It may be provided with automatic control means, e.g., limit switches, to reverse the upper jaw movement at the end of each stroke, in which case the operator can concentrate on supplying the body shells to the jaws.

I claim:

1. A method of crushing scrap metal and the like, comprising:

(a) providing a jaw mechanism comprising a lower jaw member having a platform pivotally connected to an upper jaw member including a press plate which has a single generally planar operative surface, the axis of said pivotal connection being offset such that, when the platform is horizontal, the axis is above and entirely beyond one side of the platform, that side thereby being defined as the rear of the platform and the jaw mechanism including side pieces diverging towards the rear of the platform for guiding and containing scrap metal on either side of the jaw mechanism;

(b) loading a leading end of an object to be crushed on to the platform from a side opposite the above-defined rear thereof;

(c) urging the press plate towards the platform to crush the object until either the said single operative surface of the press plate has advanced to a position where it is parallel to the platform, is closer to the plane of the platform than is the said axis and, seen in plan view, does not extend across the said axis, or the rigidity of the object prevents the further advance of the press plate towards that position;

(d) moving the press plate away from the platform;

(e) loading a next portion of the object on to the platform while withdrawing the crushed end through the side pieces and from the rear of the platform; and (f) repeating steps (c), (d) and (e) in sequence until the entire object has been crushed and withdrawn from the rear of the platform.

2. A method as claimed in claim 1, including the step of opening the jaw mechanism at least as far as a position in which part of the operative surface of the press plate is as far from the plane of the platform as the said axis is from the plane of the platform, prior to carrying out at least one of steps (b) and (e).

3. A method as claimed in claim 2, wherein the object to be crushed is a motor vehicle body, and the said at least one of steps (b) and (e) is carried out until an uncrushed portion of the motor vehicle body is hard against the operative surface of the press plate, thereby correctly positioning the said uncrushed portion over the platform.

4. A method as claimed in claim 1, wherein the object to be crushed is a motor vehicle body, comprising the preliminary step of removing the engine of the motor vehicle by engaging the engine with an engine grab mounted on the upper jaw member and then raising the upper jaw on the said pivotal connection.

5. A method as claimed in claim 4, wherein the motor vehicle body is held down by means of fork tines extending forwardly from the lower jaw member ahead of the platform while the upper jaw member is raised.

6. A method of crushing scrap metal and the like, comprising the steps of:

(a) providing a jaw mechanism defined by a lower jaw member having a platform pivotally connected to an upper jaw member, the upper jaw member including a press plate having a single substantially planar operative surface, the axis of the pivotal connection being offset such that, when the platform is horizontal, the axis is disposed above and beyond one side of the platform, which side defines the rear of the platform;

(b) loading a leading end of an object to be crushed onto the platform from a side opposite the rear thereof;

(c) urging the press plate towards the platform to crush the object until either the single operative surface of the press plate has advanced to a position wherein it is parallel to the platform, is closer to the plane of the platform than the axis of the pivotal connection and, as seen in plan view, does not extend across the axis of pivotal connection, or the rigidity of the object prevents the further advance of the press plate towards such position;

(d) moving the press plate away from the platform;

(e) loading a next portion of the object onto the platform while tilting the platform downwardly at the rear thereof to permit gravity withdrawal of the crushed end of the object from the rear of the platform; and (f) repeating steps (c), (d) and (e) in sequence until the entire object has been crushed and withdrawn from the rear of the platform.

7. The method of claim 6 wherein at least during one of steps (b) and (c), the object is partially supported on fork tines extending forwardly from the lower jaw member ahead of the platform.

8. An apparatus for crushing objects of scrap metal and the like, and including a jaw mechanism comprising a lower jaw member having a platform on which an object to be crushed can be supported, an upper jaw member having a press plate, the upper jaw member being connected to the platform through a pivotal connection, and closure means for urging at least one of the press plate and the platform towards the other to crush an object supported on the platform, wherein:

(a) the press plate includes a single substantially planar operative surface;

(b) the jaw mechanism is capable of closing to at least a position wherein the press plate and the platform are placed in a spaced parallel disposition with respect to each other;

(c) the axis of the pivotal connection is disposed above the press plate and outside the perimeters of both the press plate and the platform when the platform is horizontal, and the press plate and the platform are placed in the spaced parallel disposition with respect to each other;

(d) the axis of the pivotal connection is disposed at the side of the platform defining in part the rear of the jaw mechanism;

(e) the rear of the jaw mechanism is open or openable for discharging crushed objects therefrom; and (f) the jaw mechanism includes side pieces which diverge outwardly towards the rear thereof for guiding and containing objects of scrap on either side of the jaw mechanism.

9. The apparatus of claim 8 wherein the jaw mechanism can be opened at least as far as a position in which part of the operative surface of the press plate is as far from the plane of the platform as the axis of the pivotal connection is from the plane of the platform.

10. The apparatus of claim 9 wherein the jaw mechanism may be opened until substantially all of the upper jaw member is further from the plane of the platform than the axis of the pivotal connection is from the plane of the platform.

11. The apparatus of claim 8 wherein the lower jaw member includes a support frame for the platform and a rearward and upward extension to the support frame on either side of the platform to provide support means for the pivotal connection.

12. The apparatus of claim 11 wherein the upper jaw member includes a pair of parallel cranked arms having rearward and forward ends, with the rearward ends being engaged with the pivotal connection, and a reinforcing framework for the press plate disposed between the forward ends.

13. The apparatus of claim 11 wherein the closure means include upstanding support members disposed on opposite sides of the platform.

14. The apparatus of claim 13 further including a cross beam carried by the support members above the upper jaw member and the closure means is mounted on the cross beam.

15. An apparatus for crushing objects of scrap metal and the like, and including a jaw mechanism comprising a lower jaw member having a platform on which an object to be crushed can be supported, an upper jaw member having a press plate, the upper jaw member being connected to the platform through a pivotal connection, and closure means for urging at least one of the press plate and the platform towards the other to crush an object supported on the platform, wherein:

(a) the press plate includes a single substantially planar operative surface;

(b) the jaw mechanism is capable of closing to at least a position wherein the press plate and the platform are placed in a spaced parallel disposition with respect to each other;

(c) the axis of the pivotal connection is disposed above the press plate and outside the perimeters of both the press plate and the platform when the platform is horizontal, and the press plate and the platform are placed in the spaced parallel disposition with respect to each other;

(d) the axis of the pivotal connection is disposed at a side of the platform defining in part the rear of the jaw mechanism;

(e) the rear of the jaw mechanism is open or openable for discharging crushed objects thereform; and (f) the apparatus includes means for tilting the rear of the jaw mechanism downwardly to permit gravity discharge of crushed objects from the rear of the platform.

16. The apparatus of claim 15 further including an openable gate disposed at the rear of the platform for regulating the discharge of crushed objects from the rear of the platform.

17. The apparatus of claim 15 further including a plurality of fork tines carried by the lower jaw member and extending forwardly of the platform.

18. The apparatus of claim 17 further including means carried by the upper jaw member and disposed above the fork tines for pulling an engine.

19. An apparatus for crushing objects of scrap metal and the like, and including a jaw mechanism comprising a lower jaw member having a platform on which an object to be crushed can be supported, an upper jaw member having a press plate, the upper jaw member being connected to the platform through a pivotal connection, and closure means for urging at least one of the press plate and the platform towards the other to crush an object supported on the platform, wherein:

(a) the press plate includes a single substantially planar operative surface;

(b) the jaw mechanism is capable of closing to at least a position wherein the press plate and the platform are placed in a spaced parallel disposition with respect to each other;

(c) the axis of the pivotal connection is disposed above the press plate and outside the perimeters of both the press plate and the platform when the platform is horizontal, and the press plate and the platform are placed in the spaced parallel disposition with respect to each other;

(d) the axis of the pivotal connection is disposed at a side of the platform defining in part the rear of the jaw mechanism;

(e) the rear of the jaw mechanism is open or openable for discharging crushed objects therefrom;

(f) the apparatus is mounted in an operative position on a truck having a bed and a cab, wherein the jaw mechanism is disposed in a forwardly facing position adjacent the rear of the truck bed; and (g) the truck includes a table extendable from the rear of the truck bed for supporting crushed objects discharged from the rear of the platform.

20. An apparatus for crushing objects of scrap metal and the like, and including a jaw mechanism comprising a lower jaw member having a platform on which an object to be crushed can be supported, an upper jaw member having a press plate, the upper jaw member being connected to the platform through a pivotal connection, and closure means for urging at least one of the press plate and the platform towards the other to crush an object supported on the platform, wherein:

(a) the press plate includes a single substantially planar operative surface;

(b) the jaw mechanism is capable of closing to at least a position wherein the press plate and the platform are placed in a spaced parallel disposition with respect to each other;

(c) the axis of the pivotal connection is disposed above the press plate and outside the perimeters of both the press plate and the platform when the platform is horizontal, and the press plate and the platform are placed in the spaced parallel disposition with respect to each other;

(d) the axis of the pivotal connection is disposed at a side of the platform defining in part the rear of the jaw mechanism;

(e) the rear of the jaw mechanism is open or openable for discharging crushed objects therefrom;

(f) the apparatus is mounted in an operative position on a truck having a bed and a cab, wherein the jaw mechanism is disposed in a forwardly facing position adjacent the rear of the truck bed; and (g) the truck bed includes a ramp inclined downwardly onto the platform.

21. An apparatus for crushing objects of scrap metal and the like, and including a jaw mechanism comprising a lower jaw member having a platform on which an object to be crushed can be supported, an upper jaw member having a press plate, the upper jaw member being connected to the platform through a pivotal connection, and closure means for urging at least one of the press plate and the platform towards the other to crush an object supported on the platform, wherein:

(a) the press plate includes a single substantially planar operative surface;

(b) the jaw mechanism is capable of closing to at least a position wherein the press plate and the platform are placed in a spaced parallel disposition with respect to each other;

(c) the axis of the pivotal connection is disposed above the press plate and outside the perimeters of both the press plate and the platform when the platform is horizontal, and the press plate and the platform are placed in the spaced parallel disposition with respect to each other;

(d) the axis of the pivotal connection is disposed at a side of the platform defining in part the rear of the jaw mechanism;

(e) the rear of the jaw mechanism is open or openable for discharging crushed objects therefrom;

(f) the apparatus is mounted in an operative position on a truck having a bed and a cab, wherein the jaw mechanism is disposed in a forwardly facing position adjacent the rear of the truck bed; and (g) the truck includes a grab for loading objects to be crushed into the jaw mechanism and unloading crushed objects therefrom.

22. An apparatus for crushing objects of scrap metal and the like, and including a jaw mechanism comprising a lower jaw member having a platform on which an object to be crushed can be supported, an upper jaw member having a press plate, the upper jaw member being connected to the platform through a pivotal connection, and closure means for urging at least one of the press plate and the platform towards the other to crush an object supported on the platform, wherein:

(a) the press plate includes a single substantially planar operative surface;

(b) the jaw mechanism is capable of closing to at least a position wherein the press plate and the platform are placed in a spaced parallel disposition with respect to each other;

(c) the axis of the pivotal connection is disposed above the press plate and outside the perimeters of both the press plate and the platform when the platform is horizontal, and the press plate and the platform are placed in the spaced parallel disposition with respect to each other;

(d) the axis of the pivotal connection is disposed at a side of the platform defining in part the rear of the jaw mechanism;

(e) the rear of the jaw mechanism is open or openable for discharging crushed objects therefrom;

(f) the apparatus is mounted in an operative position on a truck having a bed and a cab, wherein the jaw mechanism is disposed in a forwardly facing position adjacent the rear of the truck bed; and (g) the truck includes means to raise the front of the truck bed and tilt both the truck bed and the jaw mechanism for permitting gravity removal of crushed objects through the jaw mechanism and from the truck bed.

23. An apparatus for crushing objects of scrap metal and the like, and including a jaw mechanism comprising a lower jaw member having a platform on which an object to be crushed can be supported, an upper jaw member having a press plate, the upper jaw member being connected to the platform through a pivotal connection, and closure means for urging at least one of the press plate and the platform towards the other to crush an object supported on the platform, wherein:

(a) the press plate includes a single substantially planar operative surface;

(b) the jaw mechanism is capable of closing to at least a position wherein the press plate and the platform are placed in a spaced parallel disposition with respect to each other;

(c) the axis of the pivotal connection is disposed above the press plate and outside the perimeters of both the press plate and the platform when the platform is horizontal, and the press plate and the platform are placed in the spaced parallel disposition with respect to each other;

(d) the axis of the pivotal connection is disposed at a side of the platform defining in part the rear of the jaw mechanism;

(e) the rear of the jaw mechanism is open or openable for discharging crushed objects therefrom;

(f) the apparatus is mounted in an operative position on a truck having a bed and a cab, wherein the jaw mechanism is disposed in a forwardly facing position adjacent the rear of the truck bed; and (g) both the truck bed and the jaw mechanism mounted thereon are demountable together from the truck.

* * * * *